US008766903B2

(12) United States Patent
Seo et al.

(10) Patent No.: US 8,766,903 B2
(45) Date of Patent: Jul. 1, 2014

(54) METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

(75) Inventors: Young-Jun Seo, Seoul (KR); Dong-Min Yeo, Asan-si (KR); Gi-Cherl Kim, Yongin-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1058 days.

(21) Appl. No.: 12/503,332

(22) Filed: Jul. 15, 2009

(65) Prior Publication Data

US 2010/0103202 A1 Apr. 29, 2010

(30) Foreign Application Priority Data

Oct. 29, 2008 (KR) ..... 2008-106579

(51) Int. Cl.
*G09G 3/36* (2006.01)

(52) U.S. Cl.
USPC ..... 345/102; 345/87; 345/100

(58) Field of Classification Search
USPC ..... 345/690, 204, 76–103, 211, 212
See application file for complete search history.

(56) References Cited

U.S. PATENT DOCUMENTS 7,460,103 B2 * 12/2008 Konno et al. ..... 345/102
7,852,432 B2 * 12/2010 Li et al. ..... 349/61
8,325,129 B2 * 12/2012 Oh ..... 345/102
2005/0104839 A1 5/2005 Baik
2006/0238487 A1 * 10/2006 Shih ..... 345/102
2007/0109240 A1 * 5/2007 Jung ..... 345/87
2007/0132708 A1 * 6/2007 Pan et al. ..... 345/102
2007/0296689 A1 * 12/2007 Kimura et al. ..... 345/102

FOREIGN PATENT DOCUMENTS

CN 1967643 A 5/2007
CN 101086573 A 12/2007

OTHER PUBLICATIONS

English Abstract for Publication No. CN 101086573A.
English Abstract for Publication No. CN 1967643A.

* cited by examiner

*Primary Examiner* — Duc Dinh
(74) *Attorney, Agent, or Firm* — F. Chau & Associates, LLC

(57) ABSTRACT

A light source apparatus includes a light source, a duty determining part, a luminance shifting determining part and a duty compensation part. The light source includes a plurality of light-emitting blocks. The duty determining part determines a duty of light-emitting blocks by using a block representative value obtained from a plurality of image blocks that are divided in accordance with a plurality of light-emitting blocks. The luminance shifting determining part compares block representative values of a previous frame with block representative values of a current frame to determine whether a luminance shifting is generated at an adjacent light-emitting block. The duty compensation part compensates a duty of the adjacent light-emitting blocks when the luminance shifting is generated at the adjacent light-emitting blocks. Thus, the duty of the adjacent light-emitting blocks determined as a block representative value is compensated so that an occurrence of flicker may be decreased.

20 Claims, 9 Drawing Sheets

| | | | | | | | |
|---|---|---|---|---|---|---|---|
| B41 | B42 | B43 | B44 | B45 | B46 | B47 | B48 |
| B33 | B34 | B35 | B36 | B37 | B38 | B39 | B40 |
| B25 | B26 | B27 | B28 | B29 | B30 | B31 | B32 |
| B17 | B18 | B19 | B20 | B21 | B22 | B23 | B24 |
| B9 | B10 | B11 | B12 | B13 | B14 | B15 | B16 |
| B1 | B2 | B3 | B4 | B5 | B6 | B7 | B8 |

FIG. 6A

| | | | | | | | |
|---|---|---|---|---|---|---|---|
| B1 | B2 | B3 | B4 | B5 | B6 | B7 | B8 |
| B9 | B10 | B11 | B12 | B13 | B14 | B15 | B16 |
| B17 | B18 | 100 | B20 | B21 | B22 | B23 | B24 |
| B25 | B26 | B27 | B28 | B29 | B30 | B31 | B32 |
| B33 | B34 | B35 | B36 | B37 | B38 | B39 | B40 |
| B41 | B42 | B43 | B44 | B45 | B46 | B47 | B48 |

FI(N-1)

FIG. 6B

| | | | | | | | |
|---|---|---|---|---|---|---|---|
| B1 | B2 | B3 | B4 | B5 | B6 | B7 | B8 |
| B9 | B10 | B11 | B12 | B13 | B14 | B15 | B16 |
| B17 | B18 | 75 | 75 | B21 | B22 | B23 | B24 |
| B25 | B26 | B27 | B28 | B29 | B30 | B31 | B32 |
| B33 | B34 | B35 | B36 | B37 | B38 | B39 | B40 |
| B41 | B42 | B43 | B44 | B45 | B46 | B47 | B48 |

FI(N)

FIG. 7A

| | | | | | | | |
|---|---|---|---|---|---|---|---|
| B1 | B2 | B3 | B4 | B5 | B6 | B7 | B8 |
| B9 | B10 | B11 | B12 | B13 | B14 | B15 | B16 |
| B17 | B18 | 100 | B20 | B21 | B22 | B23 | B24 |
| B25 | B26 | B27 | B28 | B29 | B30 | B31 | B32 |
| B33 | B34 | B35 | B36 | B37 | B38 | B39 | B40 |
| B41 | B42 | B43 | B44 | B45 | B46 | B47 | B48 |

FI(N-1)

FIG. 7B

| | | | | | | | |
|---|---|---|---|---|---|---|---|
| B1 | B2 | B3 | B4 | B5 | B6 | B7 | B8 |
| B9 | B10 | B11 | B12 | B13 | B14 | B15 | B16 |
| B17 | B18 | 100 | 100 | B21 | B22 | B23 | B24 |
| B25 | B26 | B27 | B28 | B29 | B30 | B31 | B32 |
| B33 | B34 | B35 | B36 | B37 | B38 | B39 | B40 |
| B41 | B42 | B43 | B44 | B45 | B46 | B47 | B48 |

FI(N)

FIG. 8A

| | | | | | | | |
|---|---|---|---|---|---|---|---|
| B1 | B2 | B3 | B4 | B5 | B6 | B7 | B8 |
| B9 | B10 | B11 | B12 | B13 | B14 | B15 | B16 |
| B17 | B18 | 100 | B20 | B21 | B22 | B23 | B24 |
| B25 | B26 | B27 | B28 | B29 | B30 | B31 | B32 |
| B33 | B34 | B35 | B36 | B37 | B38 | B39 | B40 |
| B41 | B42 | B43 | B44 | B45 | B46 | B47 | B48 |

FI(N-1)

FIG. 8B

| | | | | | | | |
|---|---|---|---|---|---|---|---|
| B1 | B2 | B3 | B4 | B5 | B6 | B7 | B8 |
| B9 | B10 | B11 | B12 | B13 | B14 | B15 | B16 |
| B17 | B18 | 90 | 90 | B21 | B22 | B23 | B24 |
| B25 | B26 | B27 | B28 | B29 | B30 | B31 | B32 |
| B33 | B34 | B35 | B36 | B37 | B38 | B39 | B40 |
| B41 | B42 | B43 | B44 | B45 | B46 | B47 | B48 |

FI(N)

FIG. 9A

| | | | | | | | |
|---|---|---|---|---|---|---|---|
| B1 | B2 | B3 | B4 | B5 | B6 | B7 | B8 |
| B9 | B10 | B11 | B12 | B13 | B14 | B15 | B16 |
| B17 | B18 | 100 | B20 | B21 | B22 | B23 | B24 |
| B25 | B26 | B27 | B28 | B29 | B30 | B31 | B32 |
| B33 | B34 | B35 | B36 | B37 | B38 | B39 | B40 |
| B41 | B42 | B43 | B44 | B45 | B46 | B47 | B48 |

FI(N-1)

FIG. 9B

| | | | | | | | |
|---|---|---|---|---|---|---|---|
| B1 | B2 | B3 | B4 | B5 | B6 | B7 | B8 |
| B9 | B10 | B11 | B12 | B13 | B14 | B15 | B16 |
| B17 | B18 | 87 | 87 | B21 | B22 | B23 | B24 |
| B25 | B26 | B27 | B28 | B29 | B30 | B31 | B32 |
| B33 | B34 | B35 | B36 | B37 | B38 | B39 | B40 |
| B41 | B42 | B43 | B44 | B45 | B46 | B47 | B48 |

FI(N)

METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

CROSS-REFERENCE TO RELATED APPLICATIONS

This application claims priority under 35 U.S.C. §119 to Korean Patent Application No. 2008-106579, filed on Oct. 29, 2008 in the Korean Intellectual Property Office (KIPO), the contents of which are herein incorporated by reference in their entirety.

BACKGROUND OF THE INVENTION

1. Field of the Invention

The present invention relates to a method of driving a light source, a light source apparatus for performing the method, and a display apparatus having the light source apparatus. More particularly, the present invention relates to a method of driving a light source for driving a light source including a plurality of light-emitting blocks by light-emitting block, a light source apparatus for performing the method, and a display apparatus having the light source apparatus.

2. Description of Related Art

Generally, a liquid crystal display (LCD) apparatus includes an LCD panel displaying an image using optical transmittance of liquid crystal molecules and a backlight assembly disposed below the LCD panel to provide the LCD panel with light.

The LCD panel includes an array substrate, a color filter substrate and a liquid crystal layer comprising the liquid crystal molecules. The array substrate includes a plurality of pixel electrodes and a plurality of thin-film transistors (TFTs) electrically connected to the pixel electrodes. The color filter substrate faces the array substrate and has a common electrode and a plurality of color filters. The liquid crystal layer is interposed between the array substrate and the color filter substrate. When an electric field generated between the pixel electrode and the common electrode is applied to the liquid crystal layer, an arrangement of liquid crystal molecules of the liquid crystal layer is altered to change optical transmissivity, so that an image is displayed. Here, the LCD panel realizes a white image of high luminance when an optical transmittance is maximized, and the LCD panel realizes a black image of low luminance when an optical transmittance is minimized.

To prevent a contrast ratio (CR) of an image from being decreased and to minimize power consumption, a method of locally dimming a light source has been developed, which controls an amount of light of the light-emitting blocks in accordance with luminance of an image corresponding to the light-emitting blocks. In the method of local dimming, the light source is divided into a plurality of light-emitting blocks to control an amount of light of the light-emitting blocks in correspondence with dark and bright display areas of the LCD panel corresponding to the light-emitting blocks.

Generally, when the method of local dimming is used, a gradation average value of pixel data may be used. The determination of the gradation average value is a low power consumption method for determining a duty of the light-emitting blocks. When the duty of the light-emitting blocks is determined by using the gradation average value, a driving duty of the light-emitting blocks is varied in accordance with a position of an image, so that luminance of an image is varied due to a variation of the driving duty. Thus, in a case of a moving image in which a predetermined image having high gradation in a dark background image and small amplitude is moved, luminance differences are generated due to a duty variation of the light-emitting blocks in accordance with a position of the predetermined image so that flicker is displayed in the LCD panel.

SUMMARY OF THE INVENTION

According to one exemplary embodiment of the present invention a method of driving a light source includes determining a duty of light-emitting blocks by using a block representative value obtained from a plurality of image blocks that are divided in accordance with a plurality of light-emitting blocks. Block representative values of a previous frame are compared with block representative values of a current frame to determine whether or not a luminance shifting is generated at an adjacent light-emitting blocks. A duty of the adjacent light-emitting blocks is compensated when the luminance shifting is generated at the adjacent the light-emitting blocks. The adjacent light-emitting blocks are driven based on the compensated duty.

According to another exemplary embodiment of the present invention, a light source apparatus includes a light source, a duty determining part, a luminance shifting determining part and a duty compensation part. The light source includes a plurality of light-emitting blocks. The duty determining part determines a duty of light-emitting blocks by using a block representative value obtained from a plurality of image blocks that are divided in accordance with a plurality of light-emitting blocks. The luminance shifting determining part compares block representative values of a previous frame with block representative values of a current frame to determine whether or not a luminance shifting is generated at an adjacent light-emitting block. The duty compensation part compensates a duty of the adjacent light-emitting blocks when the luminance shifting is generated at the adjacent light-emitting blocks.

According to still another exemplary embodiment of the present invention, a display apparatus includes a display panel, a light source and a local dimming driving part. The light source includes a plurality of light-emitting blocks to provide the display panel with light. The local dimming driving part determines a duty of the light-emitting blocks by using a block representative value obtained from an image block corresponding to the light-emitting block, and driving the light source by compensating a duty of the adjacent light-emitting blocks when a luminance shifting is generated in adjacent to the light-emitting blocks.

According to an exemplary embodiment of the present invention, a method of driving a light source, a light source apparatus for performing the method and a display apparatus having the light source apparatus, when a luminance shifting is generated between adjacent light-emitting blocks, the duty of the adjacent light-emitting blocks determined as a block representative value is compensated so that an occurrence of flicker may be decreased.

BRIEF DESCRIPTION OF THE DRAWINGS

The present invention will become more apparent by describing in detailed example embodiments thereof with reference to the accompanying drawings, in which:

FIGS. 6A-B are schematic diagrams illustrating a duty variation of light-emitting blocks according to a comparative embodiment;

FIGS. 7A-B are schematic diagrams illustrating a duty variation which is employed by a duty compensation method in accordance with one exemplary embodiment of the present invention;

FIGS. 8A-B are schematic diagrams illustrating a duty variation which is employed by a duty compensation method in accordance with another exemplary embodiment of the present invention;

FIGS. 9A-B are schematic diagrams illustrating a duty variation which is employed by a duty compensation method in accordance with still another exemplary embodiment of the present invention.

DETAILED DESCRIPTION OF EXEMPLARY EMBODIMENTS

Figure 1:
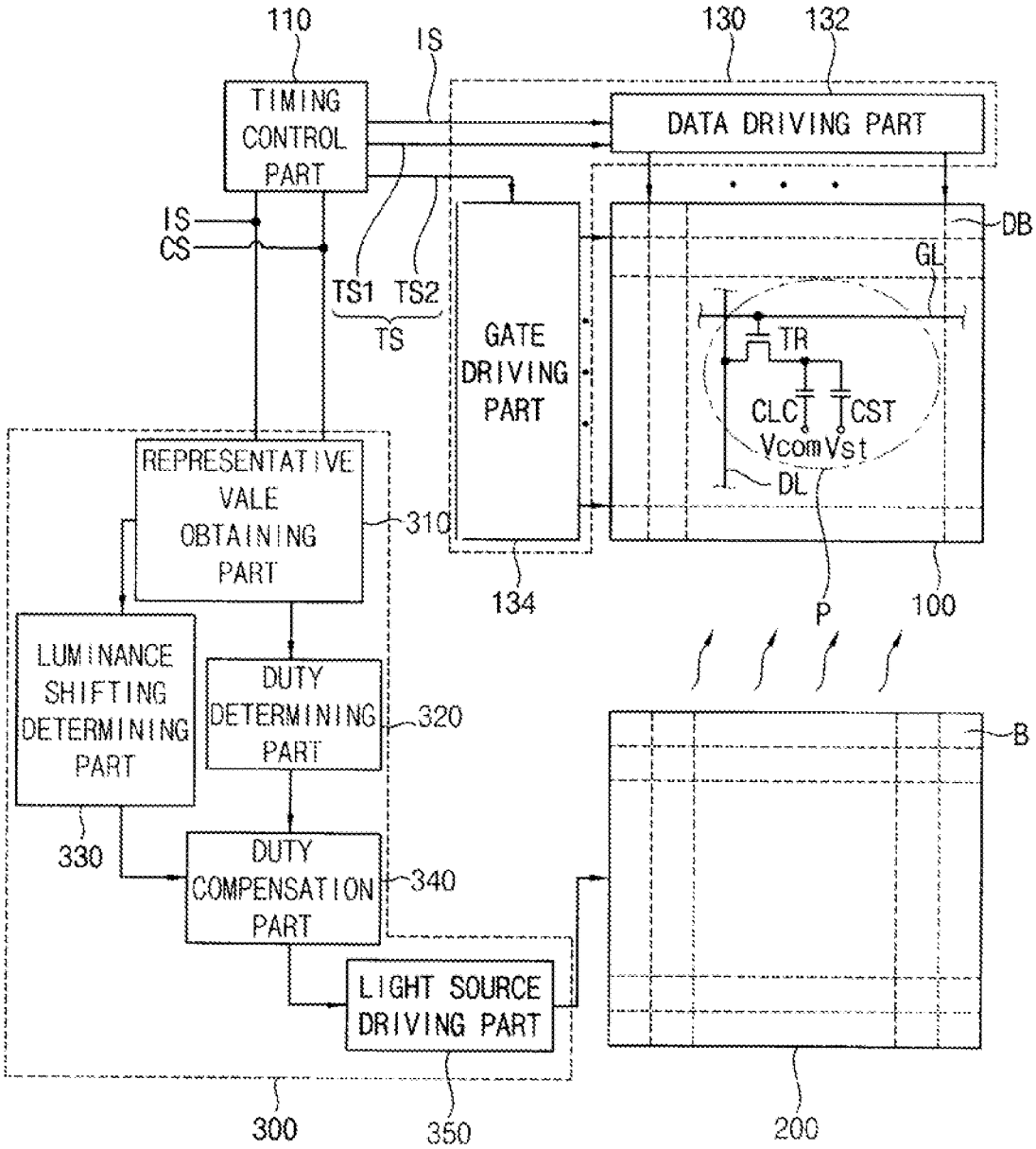
FIG. 1 is a block diagram schematically illustrating a display apparatus according to an exemplary embodiment of the present invention.

The present invention is described more fully hereinafter with reference to the accompanying drawings, in which exemplary embodiments of the present invention are shown. The present invention may, however, be embodied in many different forms and should not be construed as limited to embodiments set forth herein. Rather, exemplary embodiments are provided so that this disclosure will be thorough and complete, and will fully convey the scope of the present invention to those skilled in the art. In the drawings, the sizes and relative sizes of layers and regions may be exaggerated for clarity.

The terminology used herein is for the purpose of describing particular exemplary embodiments only and is not intended to be limiting of the present invention.

Hereinafter, the present invention will be explained in detail with reference to the accompanying drawings.

Figures 2, 3:
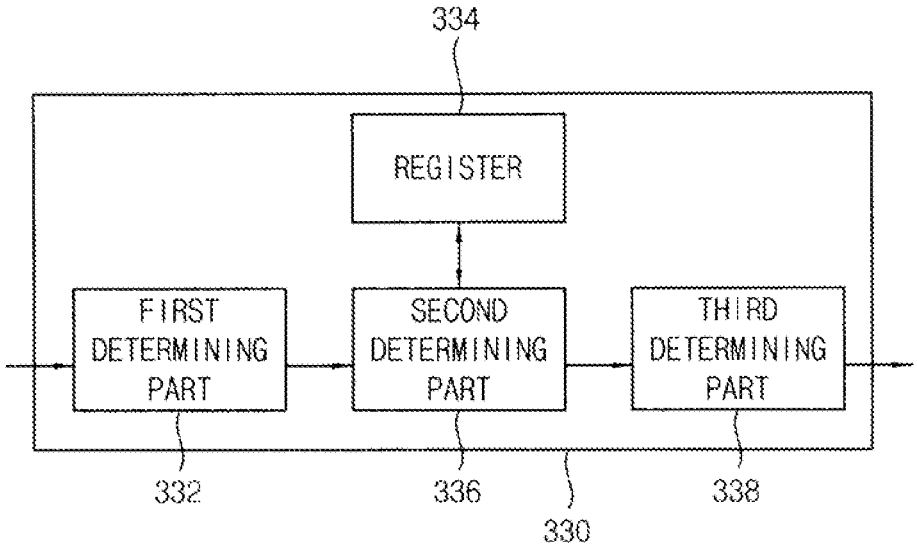
FIG. 2 is a plan view schematically illustrating a light source module of FIG. 1.
FIG. 3 is a block diagram schematically illustrating a luminance shifting determining part of FIG. 1.

FIG. 1 is a block diagram schematically illustrating a display apparatus according to an exemplary embodiment of the present invention. FIG. 2 is a plan view schematically illustrating a light source module of FIG. 1.

Referring to FIGS. 1 and 2, a display apparatus according to an exemplary embodiment of the present invention includes a display panel 100, a timing control part 110, a panel driving part 130, a light source module 200 and a local dimming driving part 300.

The display panel 100 includes a plurality of pixels for displaying image data. For example, the number of the pixels is m×n (wherein m and n are natural numbers). Each pixel P includes a switching element TR electrically connected to a gate line GL and a data line DL, and a liquid crystal capacitor CLC and a storage capacitor CST that are electrically connected to the switching element TR.

The timing control part 10 receives a control signal CS and an image signal IS from an external device (not shown). The control signal CS may include a vertical synchronizing signal, a horizontal synchronizing signal and a clock signal. The timing control part 110 generates a timing control signal TS controlling a drive timing of the panel driving part 130 by using the control signal CS.

The panel driving part 130 drives the display panel 100 using the timing control signal TS and an image signal IS received from the timing control part 110.

The panel driving part 130 may include a data driving part 132 and a gate driving part 134. The timing control signal TS includes a first control signal TS1 for controlling a drive timing of the data driving part 132 and a second control signal TS2 for controlling a driving of the gate driving part 134. The first control signal TS1 may include a clock signal and a horizontal start signal, and the second control signal TS2 may include a vertical start signal.

The data driving part 132 generates a plurality of data signals by using the first control signal TS1 and the image signal IS, and provides the data line DL with the generated data signals.

The gate driving part 134 generates a gate signal activating the gate line GL by using the second control signal TS2, and provides the gate line GL with the generated gate signal.

The light source module 200 includes a printed circuit board (PCB) having a plurality of light-emitting diodes (LEDs) mounted thereon. The LEDs may include a plurality of white LEDs. Alternatively, the LEDs may include a red LED, a green LED and a blue LED. The light source module 200 may include m×n light-emitting blocks B. Each of the light-emitting blocks B includes a plurality of LEDs. The light source module 200 may be divided into 8×6 light-emitting blocks B1, B2, . . . , B47 and B48 as shown in FIG. 2.

The local dimming driving part 300 may include a representative value obtaining part 310, a duty determining part 320, a luminance shifting determining part 330, a duty compensation part 340 and a light source driving part 350.

The representative value obtaining part 310 divides an image signal IS received from an external device (not shown) into a plurality of image blocks, and obtains a block representative value in correspondence with each of the image blocks. The block representative value may be a gradation average value corresponding to each of the image blocks. The image signal IS is input by frame unit, and may be divided into m×n image blocks in correspondence with the light-emitting blocks B. For example, the image signal IS may be divided into 8×6 image blocks in correspondence with the light-emitting blocks B.

The duty determining part 320 determines a duty for driving the light-emitting blocks B by using the block representative values received from the block representative value obtaining part 310.

The luminance shifting determining part 330 determines whether or not a luminance shifting is generated between adjacent light-emitting blocks by comparing block representative values of a previous frame FI(N−1) with block representative values of a current frame FI(N), when an input image includes a predetermined image of a white gradation in a background image of a low gradation.

FIG. 3 is a block diagram schematically illustrating a luminance shifting determining part of FIG. 1.

Referring to FIGS. 1 and 3, the luminance shifting determining part 330 includes a first determining part 332, a register 334, a second determining part 336 and a third determining part 338.

The first determining part 332 determines whether or not the input image includes a predetermined image of the white gradation in the background image of a low gradation. For example, the first determining part 332 may determine whether or not the input image includes the predetermined image of the high gradation in the background image of a low gradation by using the block representative values of the current frame FI(N). Here, the low gradation may be a black gradation, and the high gradation may be a white gradation. A size of the predetermined image may be smaller than or equal to that of one image block. Moreover, the size of the predetermined image may be equal to that of at least one of image blocks.

The register 334 stores the block representative values for the previous frame.

The second determining part 336 compares the block representative values of the current frame FI(N) received from the representative obtaining part 310 with the block representative values of the previous frame FI(N−1) stored in the register 334 to determine whether or not the luminance shifting is generated in the adjacent light-emitting blocks. For example, when a variation of a block representative value of a predetermined image block corresponding to the predetermined image is equal to a variation of a block representative value of a plurality of peripheral image blocks corresponding to a peripheral of the predetermined image, the second determining part 336 may determine as the luminance shifting is generated in the adjacent light-emitting blocks due to a moving of the predetermined image.

When the luminance shifting is generated in the adjacent light-emitting blocks, the second determining part 336 controls the duty compensation part 340 to compensate a duty of the adjacent light-emitting blocks. For example, the second determining part 336 controls the duty compensation part 340 to compensate a duty of the light-emitting blocks of the adjacent light-emitting blocks in which the block representative value is varied.

When the total of the block representative values of the current frame FI(N) is equal to that of the block representative values of the following frame FI(N+1), the third determining part 338 determines an image of the following frame FI(N+1) as a still image of the current frame FI(N). When an image of the following frame FI(N+1) is determined as the still image of the current frame FI(N), the third determining part 338 controls the duty compensation part 340 to maintain a duty of the following frame FI(N+1) as a duty of the current frame FI(N). As the determined image is positioned at a boundary between the adjacent light-emitting blocks, a flicker is substantially prevented from being generated due to a luminance variation through a duty compensation.

The duty compensation part 340 compensates a duty of the light-emitting blocks in which a duty is varied among the adjacent light-emitting blocks in accordance with a control of the luminance shifting determining part 330, and the duty compensation part does not compensate a duty of the remaining light-emitting blocks.

The duty compensation part 340 may compensate a duty of the light-emitting blocks in which a duty is varied among the adjacent light-emitting blocks. For one example, the duty compensation part 340 may compensate a duty of the light-emitting blocks in which the duty is varied by using the maximum level data (MLD) of an image block corresponding to the predetermined image.

According to another example, the duty compensation part 340 may compensate a duty of the light-emitting blocks in which the duty is varied by employing a weighted value 'a' to a duty of the light-emitting blocks in which the duty is varied. The duty compensation part 340 may compensate a duty of the light-emitting blocks in which the duty is varied through the following Equation 1.

$$D_{Bk}(c)=(1+a)D_{Bk}, 0\leq a\leq 1 \quad \text{Equation 1}$$

Here, $D_{Bk}(c)$ is the compensated duty of the light-emitting blocks in which a duty is varied ('k' is a natural number), and $D_{Bk}$ is a duty of the light-emitting blocks in which a duty is varied, that is a value determined by the block representative value. The weighted value 'a' may have a value between 0 and 1 in accordance with a duty of the light-emitting blocks in which the duty is varied. For example, the weighted value 'a' may be a value approaching '0' as the duty of the light-emitting blocks in which a duty is varied is closed to the maximum duty (100%), and the weighted value 'a' may be a value approaching '1' as the duty of the light-emitting blocks in which a duty is varied is further away from the maximum duty (100%).

According to still another example, the duty compensation part 340 may compare a duty of the previous frame with a duty of the current frame to calculate a duty decreasing amount of the light-emitting blocks in which the duty is varied, and may compensate the duty by distributing the duty decreasing amount ΔD to the light-emitting blocks in which the duty is varied. For example, the duty compensation part 340 may compensate the duty of the light-emitting blocks in which the duty is varied through the following Equation 2.

$$D_{Bk}(c)=\left(D_{Bk}+\frac{\Delta D}{n}\right) \quad \text{Equation 2}$$

Here, ΔD is the duty decreasing amount, $D_{Bk}(c)$ is the compensated duty of the light-emitting blocks in which the duty is varied ('k' is a natural number), $D_{Bk}$ is a duty of the light-emitting blocks in which a duty is varied, that is a value determined by the block representative value, and 'n' is the number of the light-emitting blocks which the duty is varied.

The light source proving part 350 generates a plurality of driving signals driving the light-emitting blocks by using a duty outputted from the duty compensation part 340. The light source driving part 350 drives the light-emitting blocks by using the driving signals.

Figure 4:
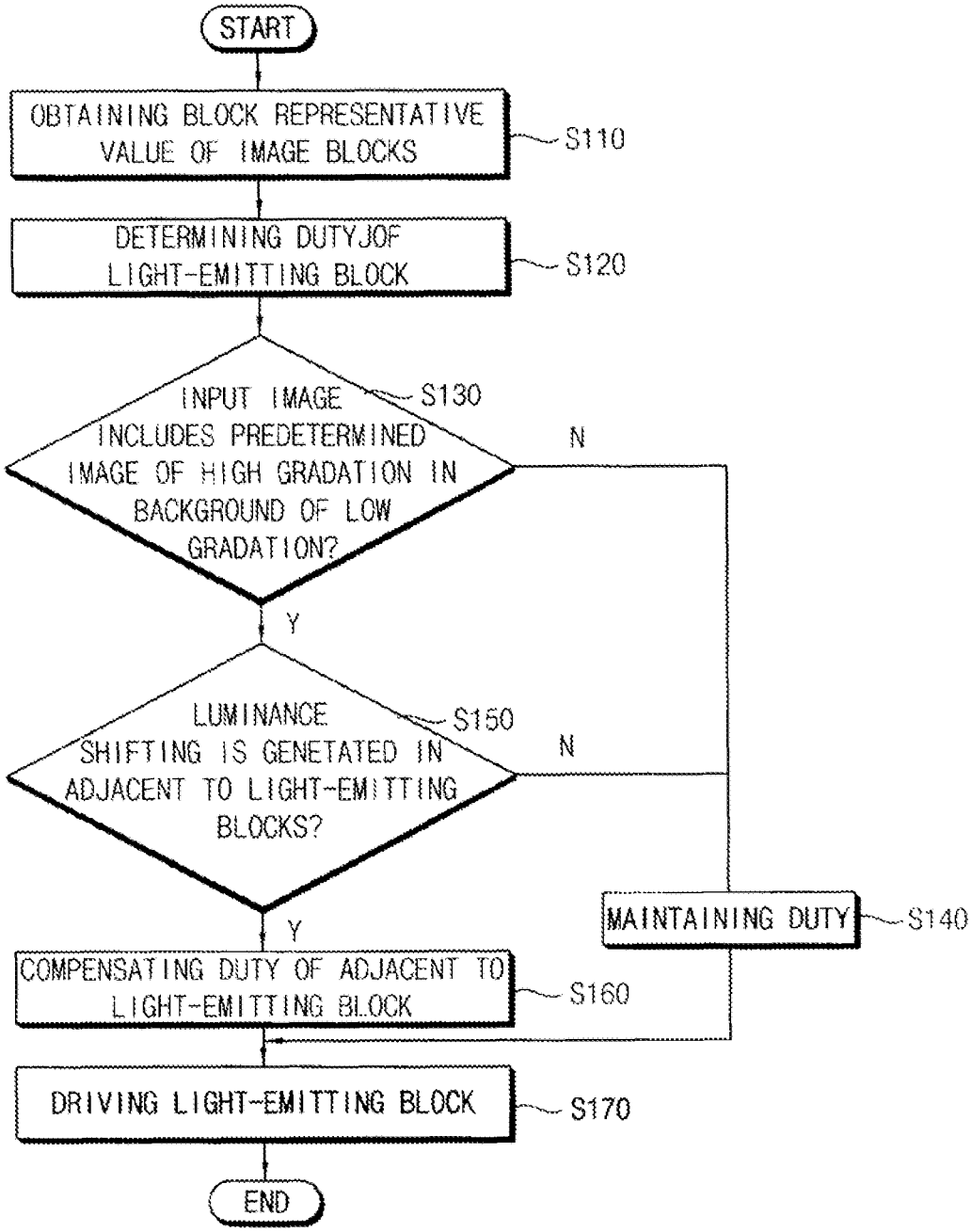
FIG. 4 is a flowchart illustrating a driving method of a local dimming driving part of FIG. 1.

FIG. 4 is a flowchart illustrating a driving method of a local dimming driving part of FIG. 1.

Referring to FIGS. 1 and 4, the representative obtaining part 310 divides an image signal IS received from an external device (not shown) into a plurality of image blocks, and obtains a block representative value corresponding to each of the image blocks (block S110). The block representative value may be a gradation average value corresponding to each of the image blocks.

The duty determining part 320 determines a duty for driving the light-emitting blocks B by using the block representative values received from the block representative obtaining part 310 (block S120).

The first determining part 332 determines whether or not the input image includes the predetermined image of a high gradation in a background image of a low gradation (block S130). The first determining part 332 may determine whether or not the input image includes the predetermined image of a white gradation at a background image of a low gradation.

In block S130, when it is determined that the input image does not include the predetermined image of the white gradation at the background image of the low gradation, the first determining part 332 controls the duty compensation part 340 to maintain a duty of the light-emitting blocks determined as the block representative value (block S140).

In block S130, when it is determined that the input image does not include the predetermined image of the white gradation at the background of the low gradation, the second determining part 336 compares the block representative values of the previous frame FI(N−1) with the block representative values of the current frame FI(N) to determine whether or not a luminance shifting is generated in the adjacent light-emitting blocks by shifting of the predetermined image (block S150).

In block S150, when it is determined that the luminance shifting is generated in the adjacent light-emitting blocks, the second determining part 336 controls the duty compensation part 340 to compensate a duty of the light-emitting blocks in which a duty is varied among the adjacent light-emitting blocks.

The duty compensation part 340 compensates a duty of the light-emitting blocks in which the duty is varied in accordance with a control of the second determining part 336 (block S160). The duty compensation part 340 does not compensate the duty of the remaining light-emitting blocks except for the light-emitting blocks in which the duty is varied. The duty compensation part 340 may compensate the light-emitting blocks in which the duty is varied by using the maximum gradation data of an image block corresponding to the predetermined image or by employing a weighted value corresponding to a duty of the light-emitting blocks in which the duty is varied that is determined as the block representative value. Moreover, the duty compensation part 340 compares the duty of the previous frame and the duty of the current frame to calculate a duty decreasing amount of the light-emitting blocks in which the duty is varied, and may compensate the duty by distributing the duty decreasing amount to the light-emitting blocks in which the duty is varied among the adjacent light-emitting blocks.

The light source driving part 350 drives the light-emitting blocks by using the driving signals generated based on the duty outputted from the duty compensation part 340 (block S170).

Hereinafter, a method of compensating a duty of adjacent light-emitting blocks will be described with reference to FIGS. 5 to 9.

Figure 5A:
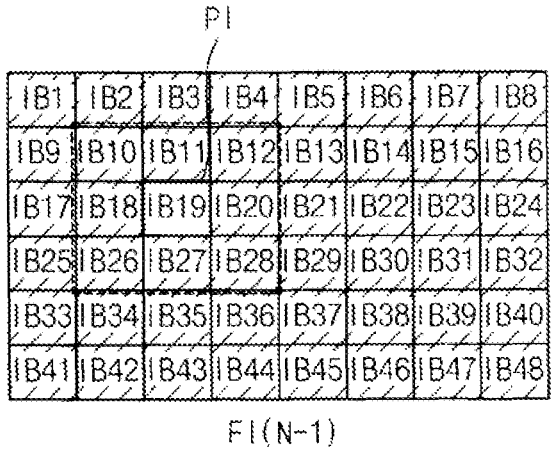
FIGS. 5A-B are schematic diagrams illustrating one example of luminance variation in accordance with a predetermined image shifting.
Figure 5B:
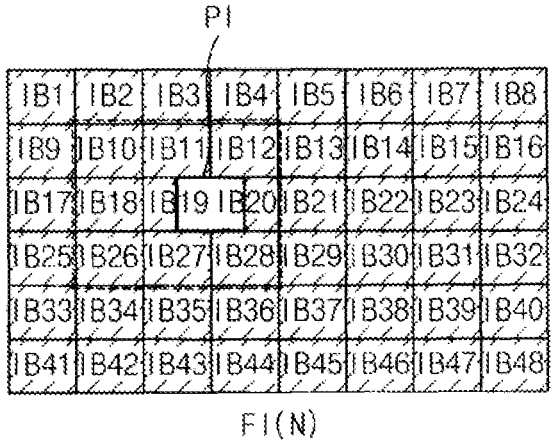

FIGS. 5A-B are schematic diagrams illustrating one example of luminance variation in accordance with a predetermined image shifting.

Referring to FIGS. 1, 2 and 5, a frame image FI may be divided into 8×6 image blocks IB1, IB2, . . . , IB47 and IB48 in correspondence with the light-emitting blocks B1, B2, . . . , B47 and B48.

It is assumed that the frame image FI includes a predetermined image PI of a white gradation in a background image of a low gradation and the predetermined image PI is shifted from a position of nineteenth block IB19 to a boundary area between the nineteenth block IB19 and the twentieth image block IB20.

The second determining part 336 compares block representative values of a previous frame FI(N−1) with block representative values of a current frame FI(N) to determine that the predetermined image PI is shifted from the nineteenth image block IB19 to a boundary area between the nineteenth image block IB19 and a twentieth image block IB20. Due to a shifting of the predetermined image block PI, a block representative value of the twentieth image block IB20 is varied from 255-gray to 128-gray, and a block representative value of the twentieth image block IB20 is varied from 0-gray to 127-gray. Also, block representative values of peripheral image blocks IB10, IB11, IB12, IB18, IB20, IB26, IB27 and IB28 positioned at peripherals of the nineteenth image block image IB19 are not varied.

A block representative value of the nineteenth image block IB19 is decreased from 255-gray to 128-gray by 127 gradations, and a block representative value of the twentieth imager block IB20 is increased from 0-gray to 127-gray by 127 gradations. When variation of the block representative value of the nineteenth image block IB19 is same as variation of the block representative value of the twentieth image block IB20, the second determining part 336 determines that a luminance shifting is generated in the adjacent light-emitting blocks. The second determining part 336 may determine that the predetermined image PI is positioned at a boundary between image blocks. When it is determined that the luminance shifting is generated in the adjacent light-emitting blocks, the second determining part 336 controls the duty compensation part 340 to compensate a duty of the light-emitting block in which a block representative value is varied among the adjacent light-emitting blocks. Thus, a light-emitting block compensated by the duty compensation part 340 may be the nineteenth and twentieth light-emitting blocks IB19 and IB20.

FIGS. 6A-B are schematic diagrams illustrating a duty variation of light-emitting blocks according to a comparative embodiment.

Referring to FIGS. 5 and 6, when the predetermined image PI is positioned at a boundary area between the nineteenth and twentieth image blocks IB19 and IB20, a duty of the light-emitting blocks corresponding to the nineteenth and twentieth image blocks IB19 and IB20 is not compensated. When the predetermined image PI is driven by a duty determined as the block representative value, a luminance difference is generated in the predetermined image PI so that flicker is displayed.

For example, as shown in FIGS. 5A-B, it is assumed that the nineteenth light-emitting block B19 corresponding to the predetermined image PI at a previous frame FI(N−1) is driven by a duty of about 100%. A duty of the nineteenth and twentieth light-emitting blocks B19 and B20 determined as the block representative value at a current frame FI(N) is about 75%. According to the comparative embodiment, a luminance of the predetermined image PI is rapidly varied, so that flicker is displayed.

FIGS. 7A-B is a schematic diagram illustrating a duty variation that is employed by a duty compensation method in accordance with one exemplary embodiment of the present invention.

Referring to FIGS. 1, 4 and 7, the duty compensation part 340 may compensate duties of the nineteenth and twentieth light-emitting blocks B19 and B20 by using the maximum gradation data of an image block corresponding to the predetermined image PI at the current frame FI(N). Thus, the duties of the nineteenth and twentieth light-emitting blocks B19 and B20 determined as the block representative value may be compensated about 75% to 100%. Therefore, flicker is not displayed.

FIGS. 8A-B are schematic diagrams illustrating a duty variation that is employed by a duty compensation method in accordance with another exemplary embodiment of the present invention.

Referring to FIGS. 1, 5 and 8, the duty compensation part 340 may adopt a weighted value 'a' to the duties of the nineteenth and twentieth light-emitting blocks B19 and B20 determined as the block representative value to compensate the duties of the nineteenth and twentieth light-emitting blocks B19 and B20. Here, the weighted value 'a' may be between '0' and '1' in accordance with the duties of the nineteenth and twentieth light-emitting blocks B 19 and B20 determined as the block representative value. It is assumed that the duties of the nineteenth and twentieth light-emitting blocks B19 and B20 determined as the block representative value are about 75%, respectively, and the weighted value 'a' is 0.2. The compensated duties of the nineteenth and twentieth light-emitting blocks B19 and B20 are calculated as (1+2) 75=90% in accordance with Equation 1. According to an exemplary embodiment of the present embodiment, great variation between a luminance of the predetermined image PI of the previous frame FI(N) and a luminance of the predetermined mage PI of the current frame FI(N) is not shown, so that flicker is not displayed.

FIGS. 9A-B are schematic diagrams illustrating a duty variation which is employed by a duty compensation method in accordance with still another exemplary embodiment of the present invention.

Referring to FIGS. 1, 5 and 9, the duty compensation part 340 compares a duty of the previous frame FI(N) with a duty of the current frame FI(N) to calculate a duty decreasing amount ΔD of a light-emitting block in which the predetermined image PI is originally positioned. That is, the duty compensation part 340 calculates the duty decreasing amount ΔD of the nineteenth light-emitting block B19 in which the predetermined image PI is originally positioned. The duty compensation part 340 distributes the duty decreasing amount ΔD to the nineteenth and twentieth light-emitting blocks B19 and B20 that are light-emitting blocks in which the duty is varied to compensate the nineteenth and twentieth light-emitting blocks B19 and B20. As the duty of the nineteenth light-emitting blocks B19 of the previous frame FI(N−1) is about 100% and the duty of the nineteenth light-emitting blocks B19 of the current frame FI(N−1) is about 75%, the duty decreasing amount ΔD is about 25%. The compensated duty of the nineteenth and twentieth light-emitting blocks B19 and B20 is calculated as 75+25/2=87% in accordance with Equation 2.

As described above, in a duty compensating method according to an exemplary embodiment of the present embodiment, the duty of the nineteenth and twentieth light-emitting blocks B19 and B20 is compensated from about 75% to about 85%, so that amount of flicker displayed may be decreased in comparison with that of the comparative embodiment.

Figure 10A:
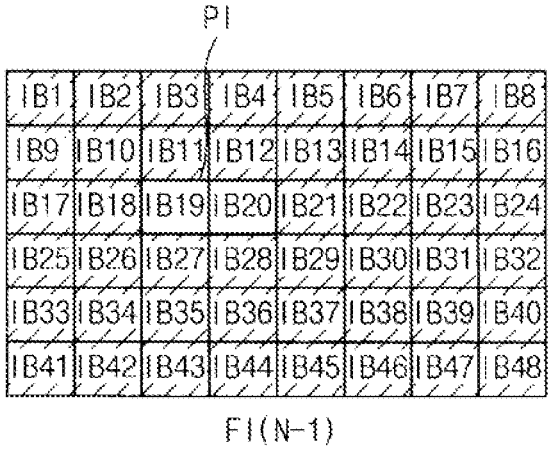
FIGS. 10A-B are schematic diagrams illustrating another exemplary embodiment of luminance variation in accordance with a predetermined image shifting.
Figure 10B:
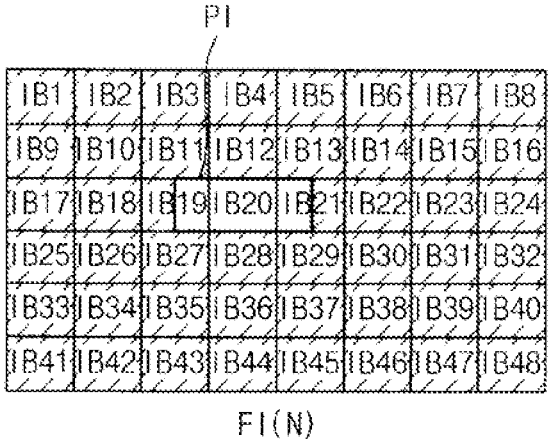

FIGS. 10A-B are schematic diagrams illustrating another example of luminance variation in accordance with a predetermined image shifting.

Referring to FIGS. 1, 2 and 10, a frame image FI may be divided into 8*6 image blocks IB1, IB2, . . . , IB47 and IB48 in accordance with the light-emitting blocks B1, B2, . . . , B47 and B48.

It is assumed that the frame image FI has a predetermined image PI of a white gradation in a background image of a low gradation and the predetermined image PI is moved to a boundary area between light-emitting blocks adjacent to the predetermined image PI. The predetermined image PI may have a size of two image blocks.

As the predetermined image PI is moved, a block representative value of nineteenth image block IB19 is decreased from 255-gray to 128-gray by 127 gradations, a block representative value of twentieth image block IB20 is not varied, and a block representative value of twenty-first image block IB21 is increased from 0-gray to 127-gray by about 127 gradations.

The duty compensation part 340 compensates duties of the nineteenth and twenty-first light-emitting blocks in which the block representative value is varied among the nineteenth and twenty-first light-emitting blocks corresponding to a position of the predetermined image PI.

For example, the duty compensation part 340 may compensate the duties of the nineteenth and twenty-first light-emitting blocks by using the maximum gradation data of an image block corresponding to the predetermined image PI. Thus, the duties of the nineteenth and twenty-first light-emitting blocks may be compensated from about 75% to about 100%.

Moreover, the duty compensation part 340 may compensate the duties of the nineteenth and twenty-first light-emitting blocks by employing a weighted value 'a'. It is assumed that the duties of the nineteenth and twenty-first light-emitting blocks that are determined by the block representative value are about 75%, respectively, and the weighted value 'a' is 0.2. Compensated duties of the nineteenth and twenty-first light-emitting blocks may be calculated as (1+0.2)/75=90% in accordance with Equation 1.

The duty compensation part 340 may compensate the duty by distributing a duty decreasing amount ΔD of the nineteenth light-emitting block where the predetermined image PI is positioned to the nineteenth and twenty-first light-emitting blocks that are the light-emitting blocks in which the duty is varied. When the duty decreasing amount ΔD of the nineteenth light-emitting block is about 25%, the compensated duties of the nineteenth and twenty-first light-emitting blocks are calculated as 75+25/2=87% in accordance with Equation 2.

According to exemplary duty compensation methods, the duty variation of the light-emitting blocks due to a moving of the predetermined image PI may be compensated, so that an occurrence of flicker may be decreased.

As described above, according to an exemplary embodiment of the present invention, when an input image includes a predetermined image of a white gradation in a background image of a low gradation and a luminance shifting is generated in adjacent light-emitting blocks due to a moving of the predetermined image, the duty of the adjacent light-emitting blocks determined as a block representative value is compensated, so that an occurrence of flicker may be decreased. Therefore, display quality of an image displayed on a display apparatus may be improved.

The foregoing is illustrative of the present invention and is not to be construed as limiting thereof. Although exemplary embodiments of the present invention have been described, those skilled in the art will readily appreciate that many modifications are possible in exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. The present invention is defined by the following claims, with equivalents of the claims to be included therein.

What is claimed is:

1. A method of driving a light source, the method comprising:

determining the duty of each light-emitting block among m×n light-emitting blocks by using a block representative value obtained from each of a plurality of m×n image blocks that are divided from a frame to correspond with the plurality of light-emitting blocks, wherein m is an integer, and n is an integer;

comparing block representative values obtained from the image blocks of a previous frame with block representative values obtained from the image blocks of a current frame to determine whether a luminance shifting is occurring at first and second adjacent light-emitting blocks;

compensating at least one of the duty of the first adjacent light-emitting block and the duty of the second adjacent light-emitting block if the luminance shifting is occurring at the first and second adjacent light-emitting blocks; and driving the first and second adjacent light-emitting blocks based on a compensated duties.

2. The method of claim 1, further comprising:

determining whether an input image includes the predetermined image at a background image of a low gradation by using a gradation data of a current frame, wherein determining whether the luminance shifting is occurring in the first and second adjacent light-emitting blocks is performed only if it is determined that the input image includes the predetermined image at the background image of the low gradation.

3. The method of claim 2, wherein determining whether the luminance shifting is occurring in the adjacent light-emitting blocks includes determining that the luminance shifting is occurring at the first and second adjacent light-emitting blocks due to a shifting of the predetermined image, when a variation of a block representative value in a predetermined image block where the predetermined image is positioned is substantially equal to a variation of a block representative value at a plurality of peripheral image blocks positioned at a peripheral of a center of the predetermined image block.

4. The method of claim 1, further comprising:

determining an image of the following frame as a still image of the current frame if the total of the block representative values is substantially equal to the total of the block representative values of a following frame, wherein compensating a duty of the adjacent to the light-emitting blocks maintains a duty of the following frame to a compensated duty of the current frame if it is determined that the following frame is the still image of the current frame.

5. The method of claim 4, wherein the block representative value is a gradation average value of each of the image blocks.

6. The method of claim 5, wherein compensating the duties of the first and second adjacent light-emitting blocks compensates the duties of the first and second light-emitting blocks by using the maximum gradation data of an image block corresponding to the predetermined image.

7. The method of claim 5, wherein compensating the duties of the first and second adjacent light-emitting blocks compensates the duties of the first and second light-emitting blocks by employing a weighted value to the duties of the first and second light-emitting blocks.

8. The method of claim 7, wherein the compensated duty of the first adjacent light-emitting block is calculated according to:

$$D_{Bk}(c)=(1+a)D_{Bk}, 0\leq a\leq 1$$

wherein $D_{Bk}(c)$ is the compensated duty of the $k^{th}$ light-emitting block of which a duty is varied, 'a' is a weighted value and $D_{Bk}$ ('k' is a natural number) is a duty of the $k^{th}$ light-emitting block of which a duty is varied.

9. The method of claim 5, wherein compensating the duties of the first and second adjacent light-emitting blocks calculates a duty decreasing by comparing the duty of the previous frame with the duty of the current frame, and distributes the duty decreasing to the light-emitting blocks of which the duty is varied to compensate the duty.

10. The method of claim 9, wherein the compensated duties of the first and second light-emitting blocks is calculated according to:

$$D_{Bk}(c)=\left(D_{Bk}+\frac{\Delta D}{n}\right)$$

wherein $\Delta D$ is the duty decreasing, $D_{Bk}(c)$ is the compensated duty of the $k^{th}$ light-emitting block of which a duty is varied, $D_{Bk}$ ('k' is a natural number) is the duty of the $k^{th}$ light-emitting block of which a duty is varied, and 'n' is the total number of the light-emitting blocks of which the duty is varied.

11. A light source apparatus comprising:

a light source comprising a plurality of m×n light-emitting blocks, wherein m is an integer, and n is an integer;

a duty determining part determining the duty of each light-emitting block among them □ n light-emitting blocks by using a block representative value obtained from a plurality of m×n image blocks that are divided from a frame to correspond with the plurality of m×n light-emitting blocks;

a luminance shifting determining part comparing block representative values obtained from the image blocks of a previous frame with block representative values obtained from the image blocks of a current frame to determine whether a luminance shifting is occurring at first and second adjacent light-emitting blocks; and a duty compensation part compensating at least one of the duty of first adjacent light-emitting block and the duty of second adjacent light-emitting block if the luminance shifting is occurring at the first and second adjacent light-emitting blocks.

12. The light source apparatus of claim 11, wherein the luminance shifting determining part comprises:

a first determining part determining whether an input image includes a predetermined image of a high gradation in a background image of a low gradation by using gradation data of the current frame;

a register storing the block representative values for the previous frame; and a second determining part comparing the block representative values of the previous frame with the block representative values of the current frame to determine whether the luminance shifting is occurring in the adjacent light-emitting blocks, only if the input image includes the predetermined image of the high gradation in a background image of the low gradation.

13. The light source apparatus of claim 12, whether the luminance shifting determining part further comprises a third determining part determining an image of the following frame as a still image of the current frame if the sum of the block representative values of the current frame is equal to that of the block representative value of the following frame, and the duty compensation part maintains the duty of the following frame to the duty of the current frame if it is determined that the following frame is a still image of the current frame.

14. The light source apparatus of claim 13, wherein the duty compensation part compensates the duty of the first and second adjacent light-emitting blocks by using the maximum gradation data of an image block corresponding to the predetermined image.

15. The light source apparatus of claim 13, wherein the duty compensation part compensates the duties of the first and second adjacent light-emitting blocks by employing a weighted value into the duties of the first and second light-emitting blocks.

16. The light source apparatus of claim 13, wherein the duty compensation part comprises a register storing a duty for the previous frame, and the duty compensation part calculates a duty decreasing amount of the first and second adjacent light-emitting blocks by comparing a duty for the previous frame with a duty for the current frame, and distributes the duty decreasing amount into the duties of first and second adjacent light-emitting blocks.

17. A display apparatus comprising:

a display panel;

a light source comprising a plurality of light-emitting blocks to provide the display panel with light; and a local dimming driving part for determining a duty of the light-emitting blocks by using a block representative value obtained from image blocks corresponding to the light-emitting blocks, and driving the light source by compensating the duties of first and second adjacent light-emitting blocks if a luminance shifting is occurring in the first and second adjacent light-emitting blocks, wherein the local dimming driving part comprises a luminance shifting determining part for comparing block representative values obtained from the image blocks of a previous frame with block representative values obtained from the image blocks of a current frame to determine whether a luminance shifting is occurring at the first and second adjacent light-emitting blocks.

18. The display apparatus of claim 17, wherein the local dimming driving part further comprises:

a duty determining part for determining a duty of light-emitting blocks by using a block representative value obtained from a plurality of image blocks that are divided to correspond with a plurality of light-emitting blocks;

a duty compensation part for compensating the duty of the first and second adjacent light-emitting blocks if the luminance shifting is occurring at the first and second adjacent light-emitting blocks; and a light source driving part driving the first and second adjacent light-emitting blocks based on the compensated duties of the first and second adjacent light-emitting blocks.

19. The display apparatus of claim 17, wherein the luminance shifting determining part comprises:

a first determining part determining whether an input image includes a predetermined image of a high gradation in a background image of a low gradation by using gradation data of the current frame;

a register storing the block representative values for the previous frame; and a second determining part comparing the block representative values of the previous frame with the block representative values of the current frame to determine whether the luminance shifting is occurring in the first and second adjacent light-emitting blocks, if the input image includes the predetermined image of the high gradation in a background image of the low gradation.

20. The display apparatus of claim 17, whether the luminance shifting determining part further comprises a third determining part determining an image of the following frame as a still image of the current frame if the sum of the block representative values of the current frame is equal to that of the block representative value of the following frame, and the duty compensation part maintains the duties of light-emitting blocks during the following frame the same as the duties of the light-emitting blocks during the current frame if it is determined that the following frame is a still image of the current frame.

* * * * *